US012673243B2

(12) United States Patent
Kitagawa

(10) Patent No.: US 12,673,243 B2
(45) Date of Patent: Jul. 7, 2026

(54) GOLF CLUB HEAD AND METHOD FOR MANUFACTURING SAME

(71) Applicant: BRIDGESTONE SPORTS CO., LTD., Tokyo (JP)

(72) Inventor: Tomonori Kitagawa, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 210 days.

(21) Appl. No.: 18/746,344

(22) Filed: Jun. 18, 2024

(65) Prior Publication Data

US 2024/0424357 A1 Dec. 26, 2024

(30) Foreign Application Priority Data

Jun. 22, 2023 (JP) ..... 2023-102548

(51) Int. Cl.
*A63B 53/04* (2015.01)

(52) U.S. Cl.
CPC ..... *A63B 53/0445* (2020.08); *A63B 53/0466* (2013.01)

(58) Field of Classification Search
CPC ..... A63B 53/0445
See application file for complete search history.

(56) References Cited

U.S. PATENT DOCUMENTS

| | | | | |
|---|---|---|---|---|
| 2013/0217513 | A1* | 8/2013 | Amano | A63B 53/04 473/331 |
| 2013/0281226 | A1 | 10/2013 | Ban | |
| 2014/0206472 | A1 | 7/2014 | Aguayo et al. | |
| 2014/0206473 | A1 | 7/2014 | Ripp et al. | |
| 2014/0378245 | A1 | 12/2014 | Ripp et al. | |
| 2015/0196812 | A1 | 7/2015 | Aguayo et al. | |
| 2016/0213984 | A1 | 7/2016 | Ripp et al. | |
| 2017/0080302 | A1 | 3/2017 | Aguayo et al. | |
| 2018/0236315 | A1 | 8/2018 | Aguayo et al. | |
| 2019/0009138 | A1 | 1/2019 | Aguayo et al. | |
| 2019/0126107 | A1* | 5/2019 | Norimura | A63B 1/00 |
| 2019/0175996 | A1* | 6/2019 | Kroloff | A63B 53/0487 |
| 2020/0001145 | A1 | 1/2020 | Aguayo et al. | |

FOREIGN PATENT DOCUMENTS

| | | | |
|---|---|---|---|
| JP | 2013-169413 | A | 9/2013 |
| JP | 2013-226204 | A | 11/2013 |
| JP | 2016-503664 | A | 2/2016 |
| JP | 2018-167089 | A | 11/2018 |
| WO | 2014/112383 | A1 | 7/2014 |

* cited by examiner

*Primary Examiner* — Raeann Gorden
(74) *Attorney, Agent, or Firm* — Sughrue Mion, PLLC

(57) ABSTRACT

A golf club head includes a first groove formed in a face portion of the head, and a second groove formed in the face portion and intersecting the first groove. A first protrusion is formed along an edge of the first groove. A second protrusion is formed along an edge of the second groove. A third protrusion is formed at an edge of an intersection between the first groove and the second groove, the third protrusion being higher than the first protrusion and the second protrusion.

9 Claims, 8 Drawing Sheets

GOLF CLUB HEAD AND METHOD FOR MANUFACTURING SAME

CROSS-REFERENCE TO RELATED APPLICATION(S)

This application claims priority to and the benefit of Japanese Patent Application No. 2023-102548 filed on Jun. 22, 2023, the entire disclosure of which is incorporated herein by reference.

BACKGROUND OF THE INVENTION

Field of the Invention

The present invention relates to a golf club head and a method for manufacturing the golf club head.

Description of the Related Art

A method for improving the hitting performance of a golf club head by the structure of a face portion has been proposed. For example, Japanese Patent Laid-Open No. 2018-167089, Japanese Patent Laid-Open No. 2016-503664, Japanese Patent Laid-Open No. 2013-169413, and Japanese Patent Laid-Open No. 2013-226204 disclose a technology for improving the coefficient of friction of the face portion by forming irregularities on the face portion. Japanese Patent Laid-Open No. 2013-169413 discloses a technology for forming protrusions (burrs) on the edges of grooves together with the grooves by laser processing.

However, in the related art, there is room for improvement in terms of friction between the face portion and a golf ball during hitting.

SUMMARY OF THE INVENTION

An object of the present invention is to provide a technology for increasing friction between a face portion and a golf ball during hitting.

According to one aspect of the present invention, there is provided a golf club head including a face portion, comprising: a first groove formed in the face portion; and a second groove formed in the face portion and intersecting the first groove, wherein a first protrusion is formed along an edge of the first groove, a second protrusion is formed along an edge of the second groove, and a third protrusion is formed at an edge of an intersection between the first groove and the second groove, the third protrusion being higher than the first protrusion and the second protrusion.

Further features of the present invention will become apparent from the following description of exemplary embodiments (with reference to the attached drawings).

DESCRIPTION OF THE EMBODIMENTS

Figure 1:
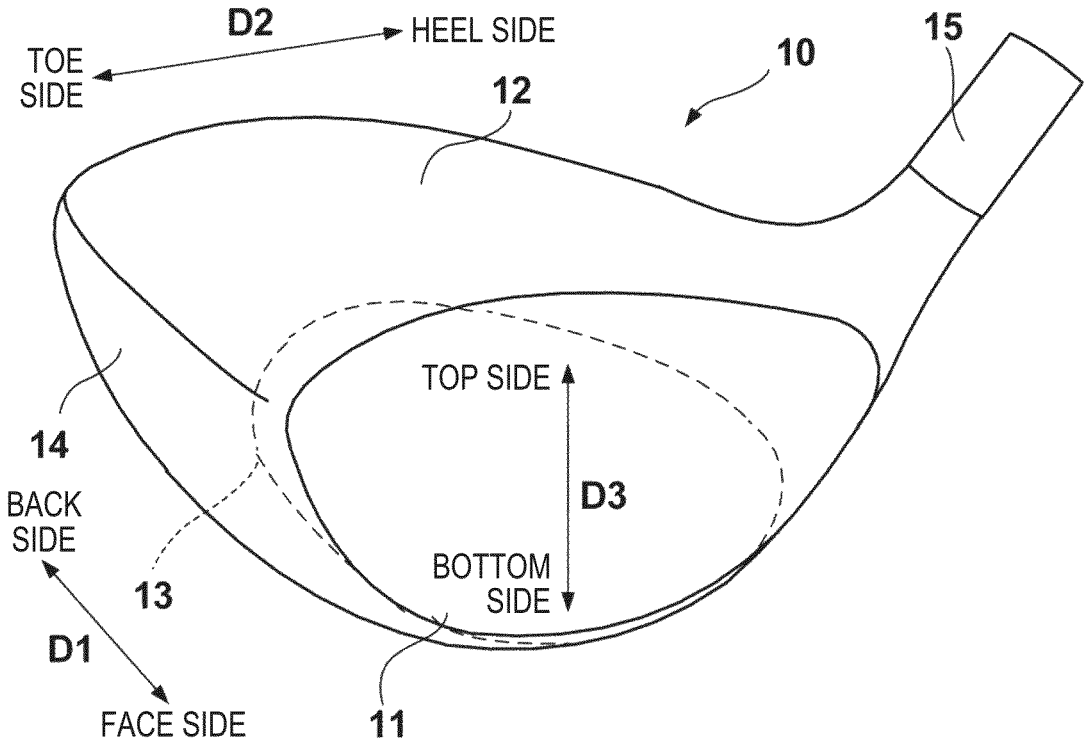
FIG. 1 is a perspective view of a golf club head according to an embodiment of the present invention.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

First Embodiment

<Overall Structure>

FIG. 1 is a perspective view of a golf club head 10 according to an embodiment of the present invention. The golf club head 10 is hollow, the peripheral wall of which constitutes a face portion 11, a crown portion 12, a sole portion 13, and a side portion 14. The surface of the face portion 11 forms a face surface (hitting surface). Bulges and rolls may be formed on the face surface. The crown portion 12 forms the top of the golf club head 10. The sole portion 13 forms the bottom of the golf club head 10. The side portion 14 forms the portion between the sole portion 13 and the crown portion 12. The golf club head 10 also includes a hosel portion 15 to which a shaft is attached.

An arrow D1 in FIG. 1 indicates the face-back direction, and an arrow D2 indicates the toe-heel direction. An arrow D3 indicates the vertical direction of the face portion 11. The face-back direction is usually the target line direction (target direction of the ball). The toe-heel direction is the direction connecting the toe-side end and heel-side end of the sole portion 13. In the present embodiment, the vertical direction of the face portion 11 is the direction along the face portion 11 and is the sole portion 13-crown portion 12 direction.

The golf club head 10 is a driver golf club head. However, the present invention is applicable to wood-type golf club heads including fairway woods other than drivers. The present invention is particularly suitable for a golf club head having a loft angle of 20 degrees or less.

The golf club head 10 may be made from a metal material, and examples of such metal materials include titanium-based metals (for example, 6Al-4V-Ti titanium alloys or the like), stainless steel, and copper alloys such as beryllium copper.

The golf club head 10 may be assembled by joining a plurality of parts. The golf club head 10 can be formed from, for example, a body member and a face member. The body member constitutes the peripheral edges of the crown portion 12, the sole portion 13, the side portion 14, and the face portion 11, and has an opening formed in a part of the portion corresponding to the face portion 11. The face member is joined to the opening in the body member.

<Face Portion>

Figure 2A:
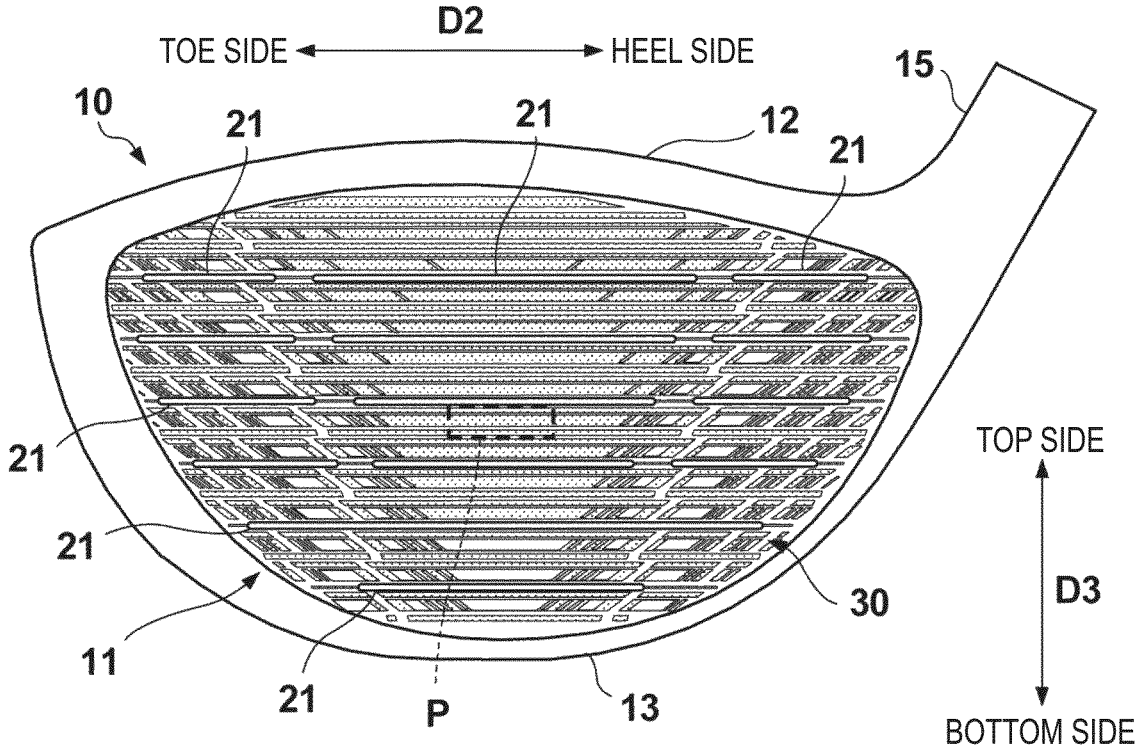
FIG. 2A is a front view of the golf club head in FIG. 1 as viewed from the face side.

FIG. 2A is a front view of the face portion 11. A plurality of patterns 21 and a roughening pattern 30 are formed on the face portion 11. The patterns 21 are formed to improve the design of the golf club head 10, to adjust the surface roughness of the face portion 11, or as indicators for a golfer to confirm the target direction and the orientation of the face portion 11 when addressing. In the present embodiment, the patterns 21 are linear-shaped grooves extending in the D2 direction, and are marks like score lines.

The roughening pattern 30 is a narrow groove pattern that is formed over the entire face portion 11 and roughens the surface thereof. In general, in a golf club head having a relatively small loft angle (e.g., 20 degrees or less), the greater the roughness of the face portion, the smaller the amount of backspin may be. That is, by increasing the friction between the face portion and the golf ball during hitting, the amount of backspin tends to decrease, which contributes to an increase in the carry. Therefore, in the present embodiment, by forming the roughening pattern 30 on the face portion 11, the friction between the face portion 11 and the golf ball during hitting is increased.

Figure 2B:
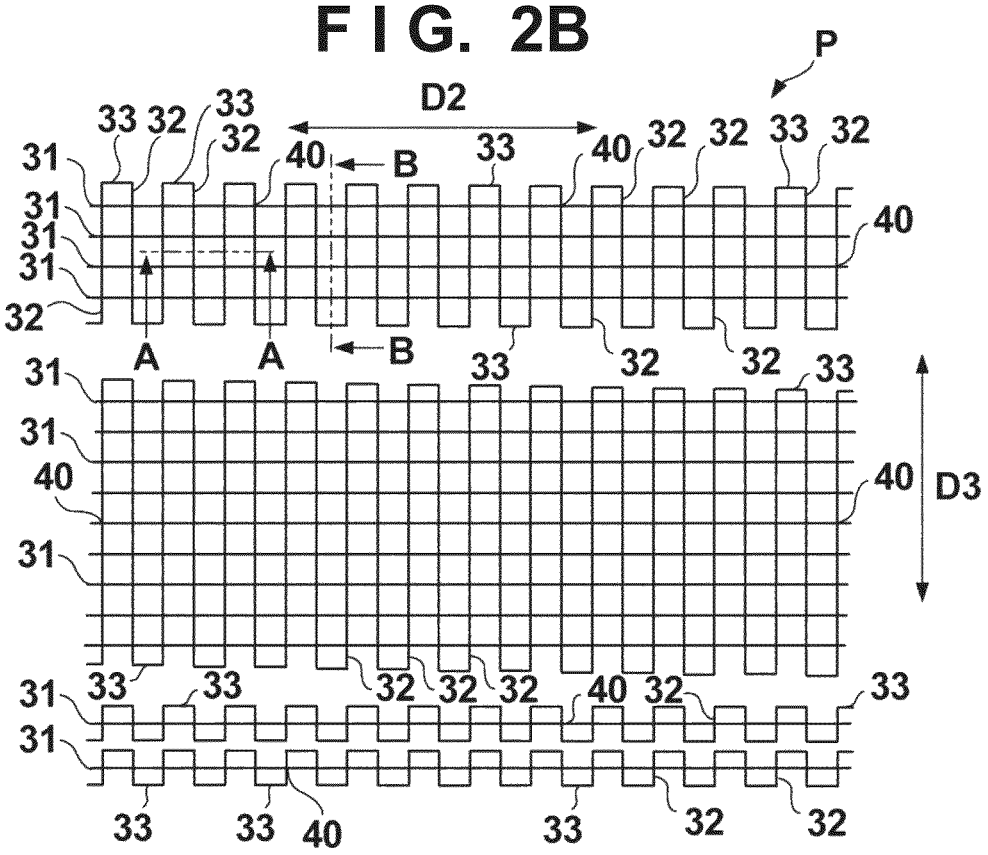
FIG. 2B is an enlarged view of a portion P in FIG. 2A.

FIG. 2B is an enlarged view of a portion P in FIG. 2A, and illustrates the detailed structure of the roughening pattern 30. The portion P is the face center of the face portion 11.

The roughening pattern 30 is composed of a plurality of narrow grooves 31 to 33. Each of the narrow grooves 31 is a linear groove extending in the D2 direction. The plurality of narrow grooves 31 are arrayed in the D3 direction. Each of the narrow grooves 32 is a linear groove extending in the D3 direction and intersects the plurality of narrow grooves 31. In the present embodiment, the narrow groove 31 and the narrow groove 32 are orthogonal to each other at an intersection 40 therebetween. The plurality of narrow grooves 32 are arrayed in the D2 direction. Each of the narrow grooves 33 is a linear groove extending in the D2 direction. Each of the narrow grooves 33 is formed so as to interconnect the ends of two narrow grooves 32 adjacent to each other in the D2 direction. The plurality of narrow grooves 32 and the plurality of narrow grooves 33 form a rectangular corrugated groove.

The roughening pattern 30 in FIG. 2B is roughly divided into three patterns: upper, middle, and lower. The three patterns are spaced apart in the D3 direction. In the upper pattern, four narrow grooves 31 are formed. In the middle pattern, nine narrow grooves 31 are formed. In the lower pattern, two narrow grooves 31 are formed. In each of the three patterns, the pitch (separation distance in the D3 direction) of adjacent narrow grooves 31 is an equal pitch.

In the upper pattern, each of the narrow grooves 32 intersects all of the four narrow grooves 31. In the middle pattern, each of the narrow grooves 32 intersects all of the four narrow grooves 31. In the lower pattern, each of the narrow grooves 32 intersects one narrow groove 31.

Figure 3C:
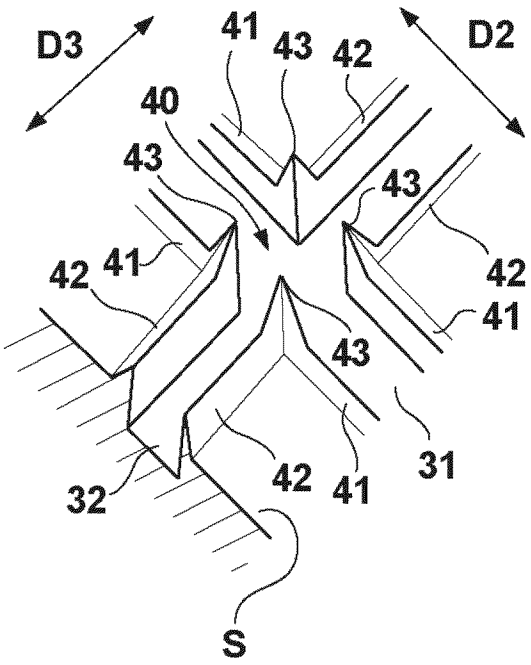
FIG. 3C is a perspective view of an intersection.
Figure 3B:
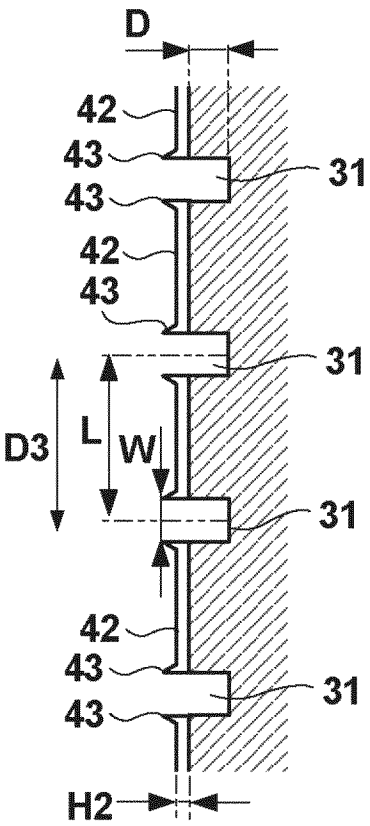
FIG. 3B is a cross-sectional view taken along line B-B in FIG. 2B.
Figure 3A:
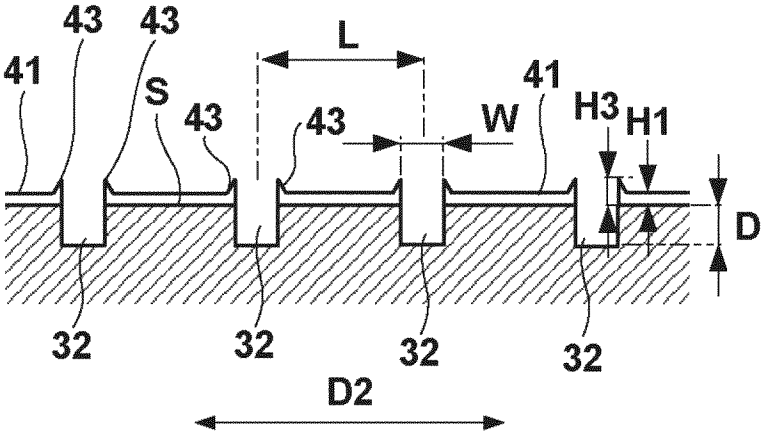
FIG. 3A is a cross-sectional view taken along line A-A in FIG. 2B.

FIG. 3A is a cross-sectional view taken along line A-A in FIG. 2B, FIG. 3B is a cross-sectional view taken along line B-B in FIG. 2B, and FIG. 3C is a perspective view of the intersection 40.

Each of the narrow grooves 31 to 33 has a depth D that is, for example, 0.003 mm or more and less than 0.025 mm. The depth D is the distance from a reference surface S to the groove bottom. The reference surface S is the flat portion of the face portion 11. Each of the narrow grooves 31 to 33 has a width W that is, for example, 0.1 mm or more and 1 mm or less. The width W is the width in the direction orthogonal to the longitudinal direction of the groove. Each of the narrow grooves 31 and 32 is disposed at a pitch L. The pitch L of each of the narrow grooves 31 and 32 is, for example, 0.1 mm or more and 1.0 mm or less. The depth D and the width W may be the same or different for the narrow grooves 31 to 33. The pitch L may also be the same or different for the narrow grooves 31 and 32.

In the case of the examples of FIGS. 3A to 3C, the cross-sectional contour shapes of the narrow grooves 31 and 32 are quadrangular. However, the cross-sectional contour shapes of the narrow grooves 31 and 32 are not limited thereto, and various contour shapes such as an arc shape, an elliptical arc shape, a triangular shape, and a trapezoidal shape can be adopted. The same applies to the narrow groove 33.

In the present embodiment, protrusions 41 are formed along both edges of each of the narrow grooves 31. Similarly, protrusions 42 are formed along both edges of each of the narrow grooves 32. Note that although not illustrated, both edges of each of the narrow grooves 33 are similarly formed with protrusions along the edges.

The protrusions 41 protrude from the reference surface S by a height H1, and the protrusions 42 protrude from the reference surface S by a height H2. The heights H1 and H2 are, for example, within the range of 0.001 mm to 0.02 mm. The formation of the protrusions 41 and 42 on the edges of the narrow grooves 31 and 32 makes it easier for the protrusions 41 and 42 to catch on the golf ball during hitting, thereby allowing an increase in the friction between the face portion 11 and the golf ball.

A protrusion 43 is formed at each edge (four locations) of the intersection 40. The protrusion 43 protrudes from the reference surface S by a height H3. There is a relationship of H3>H1 and H3>H2, and among the protrusions 41 to 43, the protrusion 43 protrudes most from the reference surface S. H3 is, for example, H3≥1.2×H1 and/or H3≥1.2×H2. In addition, H3 is, for example, H3≤2.0×H1 and/or H3≤2.0×H2. The formation of the protrusion 43 at each edge of the intersection 40 makes it easier for the protrusion 43 to catch on the golf ball during hitting, thereby allowing an increase in the friction between the face portion 11 and the golf ball.

The protrusions 41 and 42 are linear protrusions, and the protrusion 43 is a point protrusion. The combination of these two types of protrusions makes it easier for the protrusion 43 to catch on the golf ball during hitting, thereby allowing an increase in the friction between the face portion 11 and the golf ball. Among the protrusions 41 to 43, the protrusion 43 protrudes the most from the reference surface S. Therefore, even if the protrusions 41 and 42 catch on the golf ball weakly, the protrusion 43 can reliably catch on the golf ball. Since the protrusion 43 is a point protrusion, the direction in which frictional force is exerted is not limited as compared with the protrusions 41 and 42, which are linear protrusions. Friction can be increased by the protrusion 43 regardless of the relative movement direction of the face portion 11 with respect to the golf ball during hitting, such as hitting with the face portion 11 open or closed.

<Manufacturing Method>

A method for manufacturing the golf club head 10, and in particular, a method for forming the narrow grooves 31 and 32 and the protrusions 41 to 43 will be described. Note that the narrow groove 33 can be formed in the same manner.

Figure 4A:
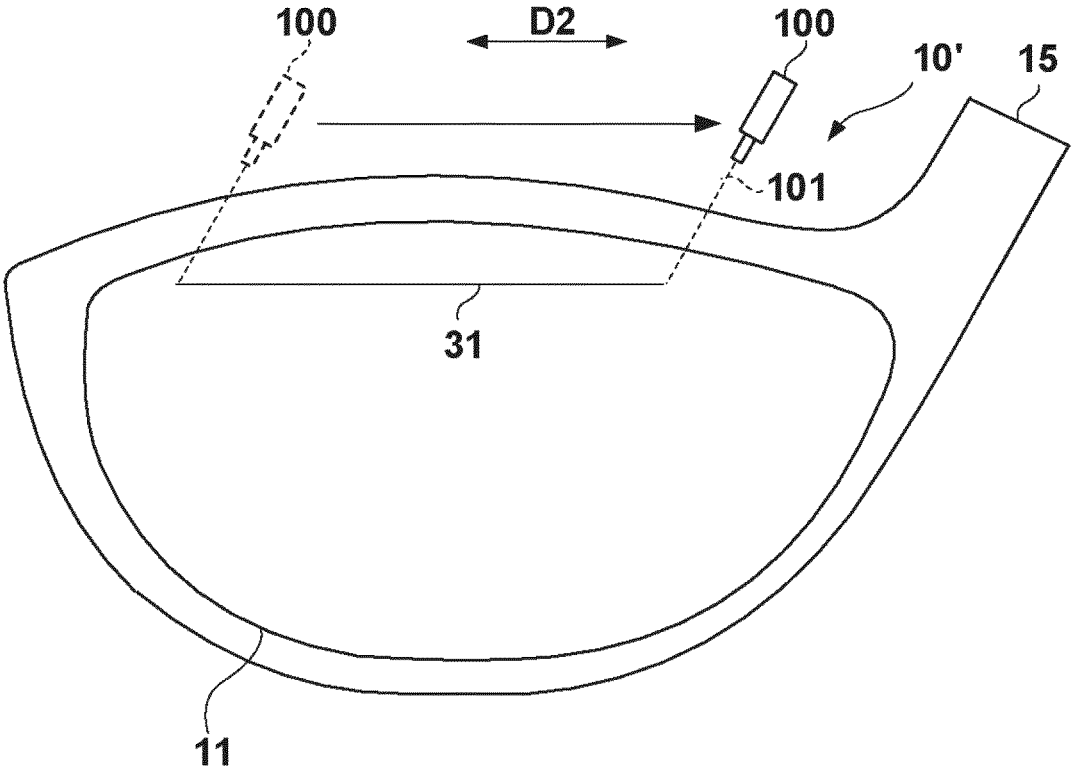
FIGS. 4A and 4B are explanatory views of a method for forming a narrow groove and a protrusion.

In the present embodiment, a case where the narrow grooves 31 and 32 and the protrusions 41 to 43 are formed by laser processing will be described. As illustrated in FIG. 4A, the narrow groove 31 is formed in a member 10' forming the face portion 11. The member 10' is a golf club head with no roughening pattern 30 formed thereon. If the golf club head 10 is assembled by joining the body member and the face member together, the member 10' may be the face member.

Figure 5A:
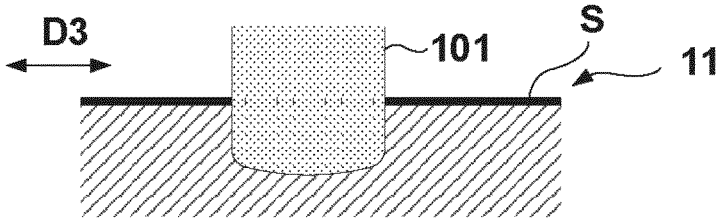
FIGS. 5A to 5D are explanatory views of a method for forming the narrow groove and protrusion.
Figure 5B:
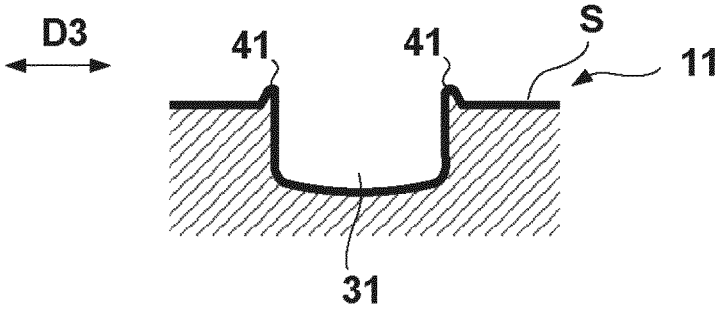

The member 10' is fixed to a processing device by a jig (not illustrated), and the processing device has a laser beam irradiation unit 100. The narrow groove 31 is formed by relatively moving the face portion 11 or the irradiation unit 100 in the D2 direction while irradiating the face portion 11 with a laser beam 101 from the irradiation unit 100. FIG. 5A illustrates a state in which the narrow groove 31 is being formed by irradiating the face portion 11 with the laser beam 101, and FIG. 5B illustrates a state in which the narrow groove 31 has been formed. As a result of formation of the narrow groove 31 by laser processing, the protrusion 41 is simultaneously and naturally formed as its "burr".

Figure 4B:
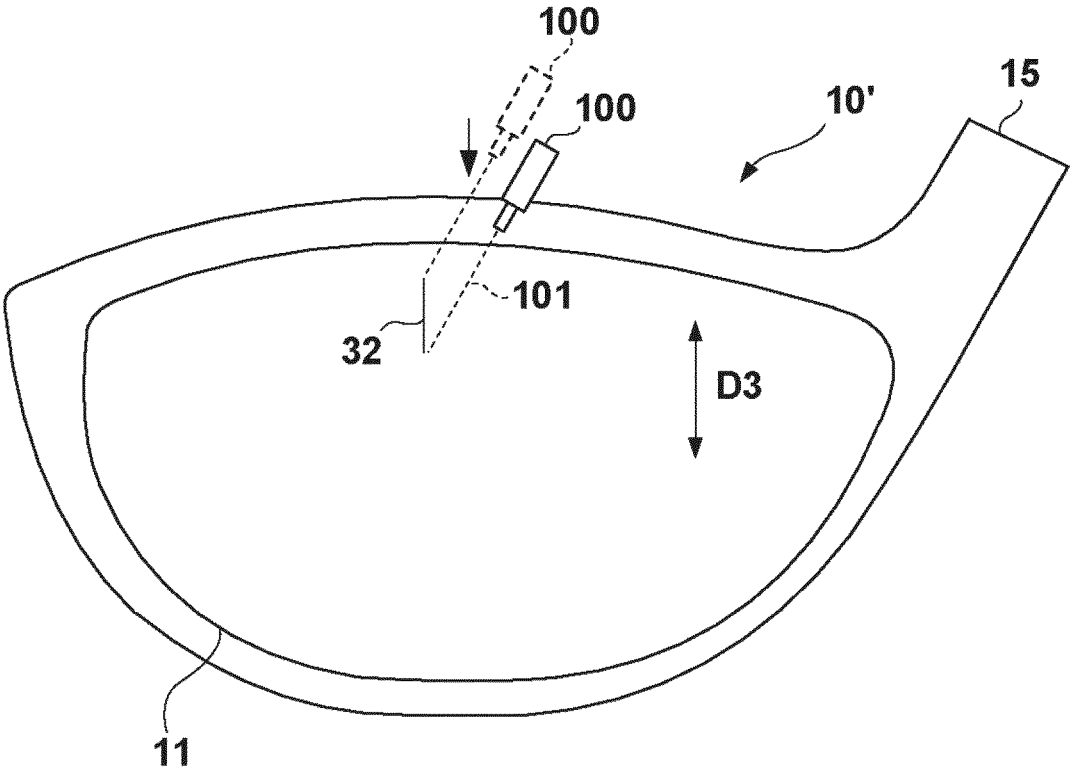
Figure 5C:
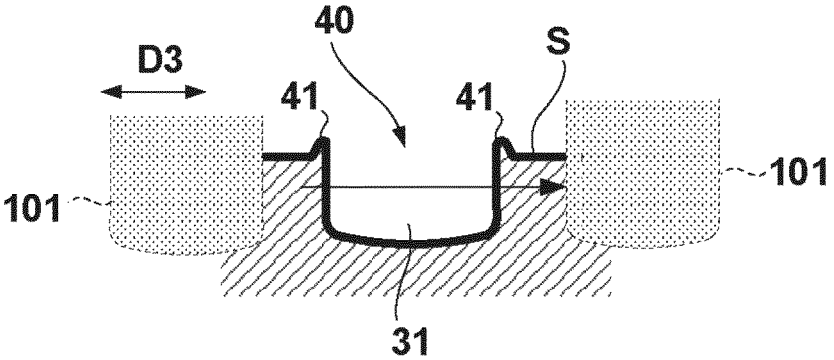
Figure 5D:
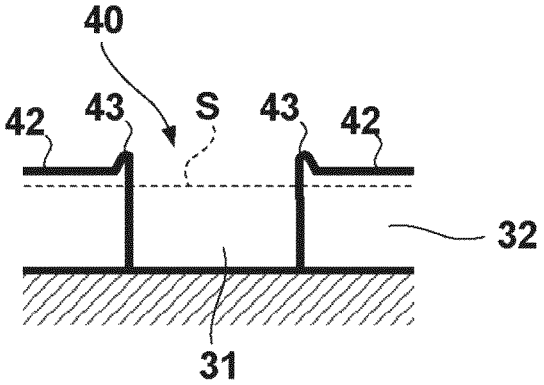

Next, as illustrated in FIG. 4B, the narrow groove 32 is formed in the member 10'. The narrow groove 32 is formed by relatively moving the face portion 11 or the irradiation unit 100 in the D3 direction while irradiating the face portion 11 with the laser beam 101 from the irradiation unit 100. FIG. 5C illustrates a state in which the narrow groove 32 is being formed by irradiating the face portion 11 with the laser beam 101, and FIG. 5D illustrates a state in which the narrow groove 32 has been formed. As a result of formation of the narrow groove 32 by laser processing, the protrusion 42 is simultaneously and naturally formed as its "burr".

Moreover, since the intersection 40 has the protrusion 41 already formed at each edge of the narrow groove 31, the protrusion 41 at the intersection 40 further swells and grows into the protrusion 43 as the laser beam 101 passes through the protrusion 41.

In this manner, it is possible to simultaneously form the protrusion 41 while forming the narrow groove 31 by laser processing, and to simultaneously form the protrusions 42 and 43 while forming the narrow groove 32. The roughening pattern 30 can be formed with fewer man-hours.

After the formation of the roughening pattern 30, it is preferable to perform a surface treatment for hardening the hardness of the face portion 11. Examples of such surface treatment include carburization treatment, nitriding treatment, soft nitriding treatment, physical vapor deposition (PVD) treatment, ion plating, diamond-like carbon (DLC) treatment, and plating treatment. In particular, surface treatments, such as carburizing and nitriding, which modify the surface without forming another metal layer on the surface are preferable.

Second Embodiment

Figure 6A:
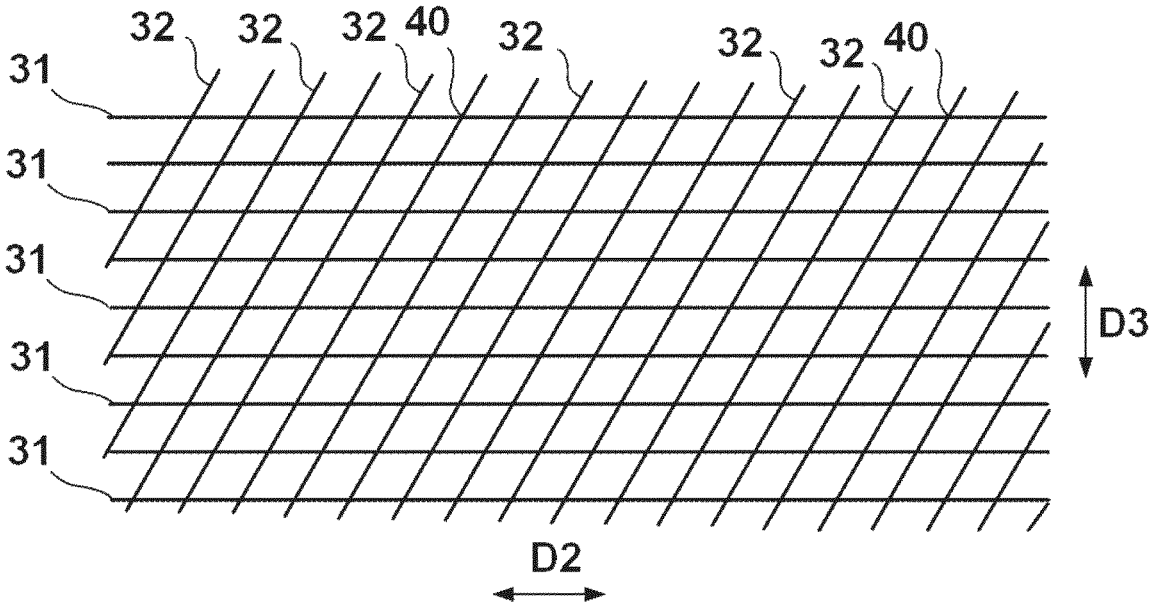
FIGS. 6A and 6B illustrate another example of a roughening pattern.

The roughening pattern 30 can adopt various forms. FIG. 6A illustrates an example thereof. The illustrated example illustrates an example in which the narrow groove 31 and the narrow groove 32 intersect at an angle other than 90 degrees. The narrow groove 31 extends in the D2 direction as in the first embodiment, but the narrow groove 32 extends not in the D3 direction but in a direction at an angle (angle θ) with respect to the D2 direction. The angle θ is, for example, within the range of 60 degrees or more and 120 degrees or less.

Figure 6B:
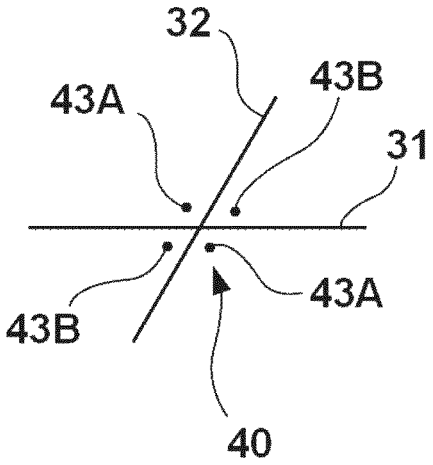

FIG. 6B is a schematic diagram of the intersection 40 in the example of FIG. 6A. Also in the example of FIG. 6A, by forming the narrow grooves 31 and 32 by laser processing, protrusions corresponding to the protrusions 41 to 43 are formed. At the four edges of the intersection 40, the intersection angles of the narrow grooves 31 and 32 are different, resulting in obtuse and acute edges. A protrusion 43A is formed at the obtuse edge, and a protrusion 43B is formed at the acute edge. Comparing the heights H3 of the protrusions 43A and 43B, the protrusion 43B tends to be higher than the protrusion 43A, and the area of the portion where the protrusion is formed tends to be larger in the protrusion 43A than in the protrusion 43B. In addition to the fact that the narrow groove 32 is inclined at the angle θ in the D2 direction, the formation of the two types of protrusions 43A and 43B at the intersection 40 changes the friction between the face portion 11 and the golf ball depending on the relative movement direction of the face portion 11 with respect to the golf ball during hitting. This allows the golfer's technical intervention to bring about changes in ball path and distance.

Figure 7A:
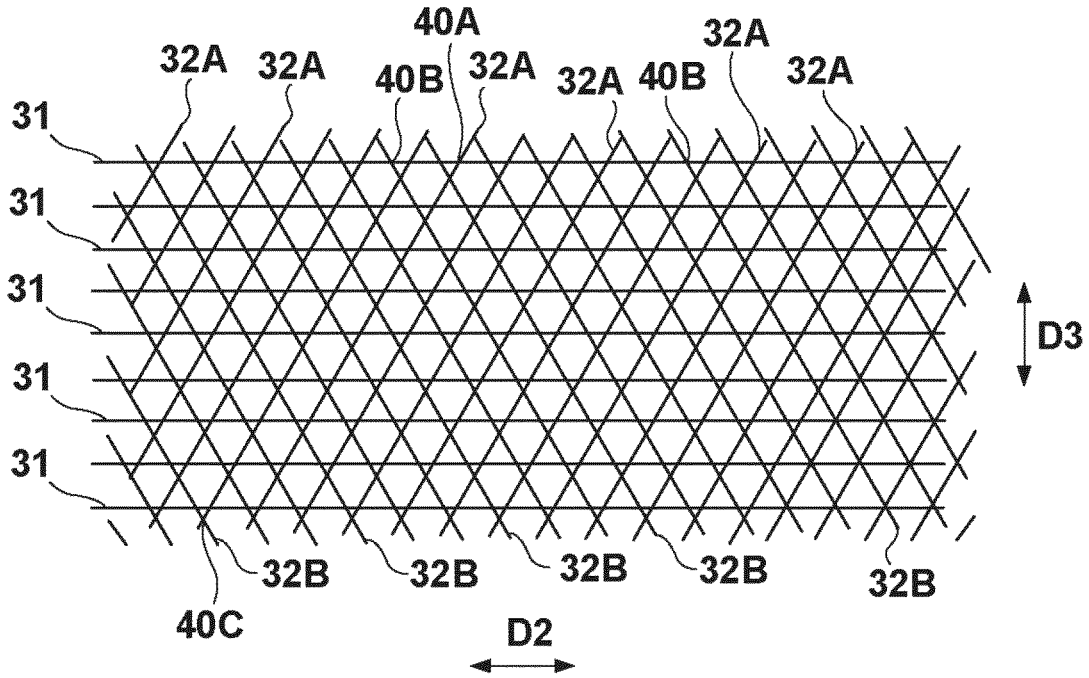
FIGS. 7A to 7C illustrate still another example of the roughening pattern.

FIG. 7A illustrates still another example of the roughening pattern 30. The illustrated example illustrates an example in which the narrow grooves 31, 32A, and 32B intersect each other. The narrow groove 31 extends in the D2 direction as in the first embodiment, but the narrow grooves 32A and 32B extend not in the D3 direction but in a direction at an angle (angle θ) with respect to the D2 direction. The angle θ of the narrow groove 32A is, for example, within the range of 60 degrees or more and less than 120 degrees. The angle θ of the narrow groove 32B is, for example, within the range of 120 degrees or more and less than 300 degrees. The narrow groove 31 and the narrow groove 32A intersect at an intersection 40A, the narrow groove 31 and the narrow groove 32B intersect at an intersection 40B, and the narrow groove 32A and the narrow groove 32B intersect at an intersection 40C. The three types of intersections 40A to 40C are present.

Figure 7B:
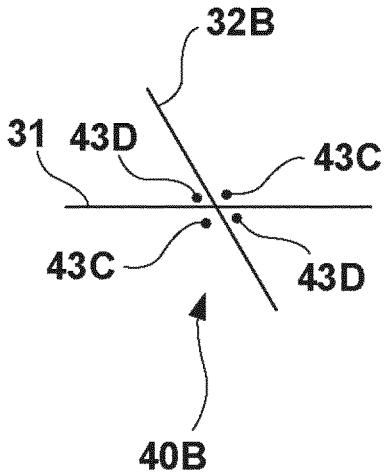
Figure 7C:
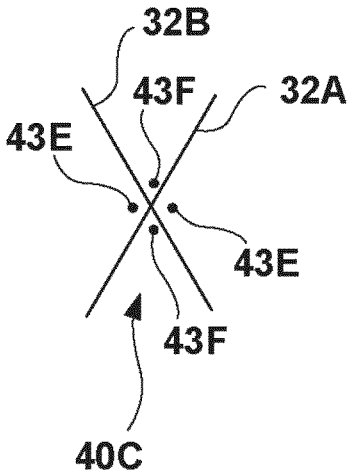

By forming the narrow grooves 31, 32A, and 32B by laser processing, protrusions corresponding to the protrusions 41 to 43 are formed. The form of the protrusion 43 at the intersection 40A is similar to that in FIG. 6B. FIGS. 7B and 7C are schematic diagrams of the intersections 40B and 40C.

At the four edges of the intersection 40B, the intersection angles of the narrow grooves 31 and 32B are different, resulting in obtuse and acute edges. A protrusion 43C is formed at the obtuse edge, and a protrusion 43D is formed at the acute edge. As in the example of FIG. 6B, when comparing the heights H3 of the protrusions 43C and 43D, the protrusion 43D tends to be higher than the protrusion 43C, and the area of the portion where the protrusion is formed tends to be larger in the protrusion 43C than in the protrusion 43D.

At the four edges of the intersection 40C, the intersection angles of the narrow grooves 32A and 32B are also different, resulting in obtuse and acute edges. A protrusion 43E is formed at the obtuse edge, and a protrusion 43F is formed at the acute edge. As in the example of FIG. 6B, when comparing the heights H3 of the protrusions 43E and 43F, the protrusion 43F tends to be higher than the protrusion 43E, and the area of the portion where the protrusion is formed tends to be larger in the protrusion 43E than in the protrusion 43F.

Comparing FIG. 7B with FIG. 7C, the protrusions 43C to 43F have different intersection angles of the narrow grooves, so that the heights and areas of the protrusions 43C to 43F can be made different.

Figure 8A:
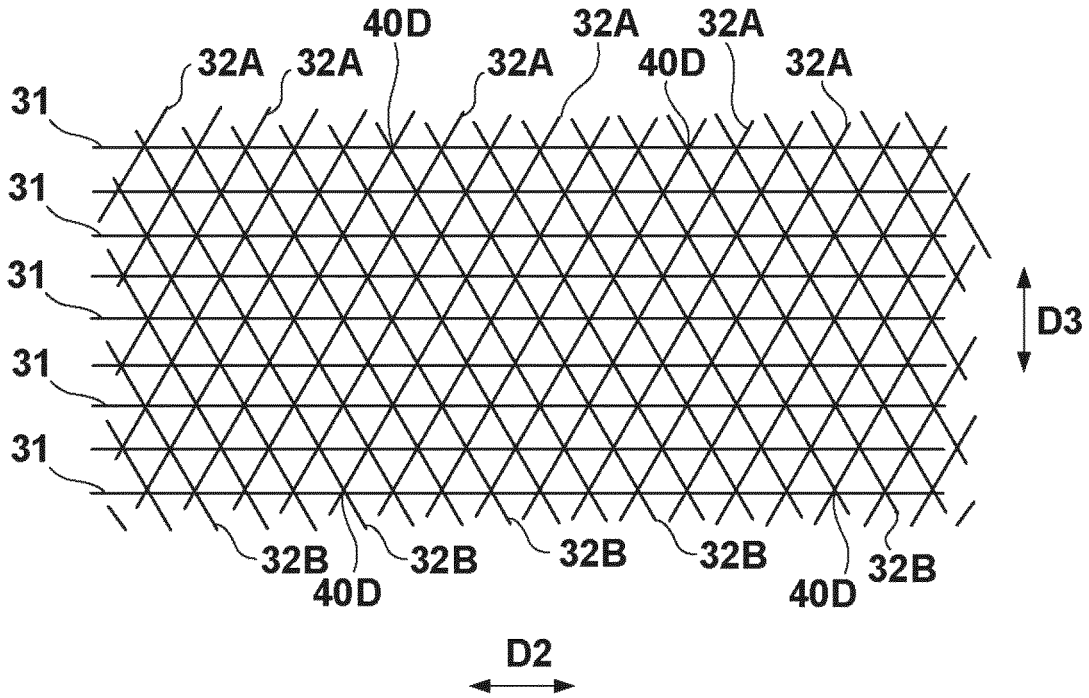
FIGS. 8A and 8B illustrate yet another example of the roughening pattern.
Figure 8B:
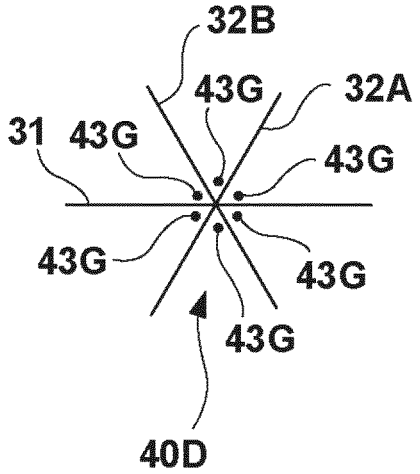

FIG. 8A illustrates yet another example of the roughening pattern 30. The illustrated example illustrates an example in which the narrow grooves 31, 32A, and 32B intersect each other similarly to the example of FIG. 7A, but the example of FIG. 8A has an intersection 40D where the three narrow grooves 31, 32A, and 32B intersect in one place. By forming the narrow grooves 31, 32A, and 32B by laser processing, protrusions corresponding to the protrusions 41 to 43 are formed. FIG. 8B is a schematic diagram of the intersection 40D.

In the intersection 40D, the three narrow grooves 31, 32A, and 32B intersect to form six edges and six protrusions 43G. It is possible to form the highest protrusion among the protrusions 43 to 43F described so far.

Other Embodiments

In the first embodiment and the second embodiment, linear grooves has been exemplified as the narrow grooves 31 to 32B, but the grooves may have a shape other than a straight line, such as a circular arc shape or a triangular wave shape.

Further, in the first embodiment and the second embodiment, an example in which the present invention is applied to a wood-type golf club head has been described, but the present invention is also applicable to other types of golf club heads such as iron-type golf club heads.

The invention is not limited to the foregoing embodiments, and various variations/changes are possible within the spirit of the invention.

What is claimed is:

1. A golf club head including a face portion, comprising:
a first groove formed in the face portion; and
a second groove formed in the face portion and intersecting the first groove, wherein
a first protrusion is formed along an edge of the first groove,
a second protrusion is formed along an edge of the second groove, and
a third protrusion is formed at an edge of an intersection between the first groove and the second groove, the third protrusion being higher than the first protrusion and the second protrusion.

2. The golf club head according to claim 1, wherein
the first groove extends in a toe-heel direction.

3. The golf club head according to claim 1, wherein
the first groove and the second groove are orthogonal to each other at the intersection.

4. The golf club head according to claim 1, wherein
the first groove and the second groove intersect each other at an angle of 45 degrees or more and less than 90 degrees at the intersection.

5. The golf club head according to claim 1, further comprising
a third groove formed in the face portion and intersecting the first groove, wherein
a fourth protrusion is formed along an edge of the third groove,
a fifth protrusion is formed at an edge of an intersection between the first groove and the third groove, the fifth protrusion being higher than the first protrusion and the fourth protrusion, and
the second groove and the third groove extend in different directions.

6. The golf club head according to claim 5, wherein
the third groove intersects the second groove, and
a sixth protrusion is formed at an edge of an intersection between the second groove and the third groove, the sixth protrusion being higher than the second protrusion and the fourth protrusion.

7. The golf club head according to claim 1, wherein
in the third protrusion,
the first groove and the second groove have a depth of less than 0.025 mm and a width of 0.1 mm or more and 1 mm or less, and
the third protrusion has a height that is 1.2 times or more a height of the first protrusion and 1.2 times or more a height of the second protrusion.

8. The golf club head according to claim 1, wherein
the golf club head is a wood-type golf club head including a crown portion and a sole portion.

9. A method for manufacturing a golf club head including a face portion, the method comprising:
a first laser processing step of forming, by laser processing, a first groove in a member forming the face portion; and
a second laser processing step of forming, by laser processing, a second groove in the member forming the face portion, the second groove intersecting the first groove, wherein
a first protrusion along an edge of the first groove is formed by the first laser processing step,
a second protrusion along an edge of the second groove and a third protrusion at an edge of an intersection between the first groove and the second groove are formed by the second laser processing step, and
the third protrusion is higher than the first protrusion and the second protrusion.

* * * * *